US005546097A

United States Patent [19]

Ramanujam et al.

[11] Patent Number: 5,546,097

[45] **Date of Patent: * Aug. 13, 1996**

[54] SHAPED DUAL REFLECTOR ANTENNA SYSTEM FOR GENERATING A PLURALITY OF BEAM COVERAGES

[75] Inventors: Parthasarathy Ramanujam, Redondo Beach; Charlie C. Shin, Torrance; Louis R. Fermelia, Jr., Westminster; Andrew J. Stambaugh, Inglewood, all of Calif.

[73] Assignee: Hughes Aircraft Company, Los Angeles, Calif.

[ * ] Notice: The portion of the term of this patent subsequent to Dec. 13, 2011, has been disclaimed.

[21] Appl. No.: 994,834

[22] Filed: Dec. 22, 1992

[51] Int. Cl.[6] ..... H01Q 19/14

[52] U.S. Cl. ..... 343/781 R; 343/781 CA; 343/837

[58] Field of Search ..... 343/781 P, 781 R, 343/781 CA, 836, 837, 840, 779, 756; H01Q 19/12, 19/13, 19/19, 13/00

[56] References Cited

U.S. PATENT DOCUMENTS

| | | | |
|---|---|---|---|
| 3,271,771 | 9/1966 | Hannan et al. | 343/781 CA |
| 3,281,850 | 10/1966 | Hannan | 343/781 CA |
| 3,927,408 | 12/1975 | Schmidt et al. | 343/779 |
| 4,017,865 | 4/1977 | Woodward | 343/781 CA |
| 4,223,316 | 9/1980 | Drabowitch | 343/781 P |
| 4,777,491 | 10/1988 | Bassi et al. | 343/781 P |
| 4,792,811 | 12/1988 | Aubry et al. | 343/781 CA |

*Primary Examiner*—Donald Hajec
*Assistant Examiner*—Tan Ho
*Attorney, Agent, or Firm*—Gordon R. Lindeen, III; William J. Streeter; Wanda K. Denson-Low

[57] ABSTRACT

A dual-reflector antenna system (40) is provided for generating a shaped main beam radiation pattern (20) and at least one additional secondary spot beam radiation pattern (30, 32). The antenna system (40) includes a main shaped reflector (10) having a shaped reflective surface (11) operatively coupled to a subreflector (12) for communicating therewith. A main feed horn (14) communicates directly with the subreflector (12) so as to reflect first energy to and from the main reflector (10) within a shaped beam radiation pattern (20). In a preferred embodiment, the subreflector (12) has an ellipsoidal reflective surface (13) which communicates directly with the main reflector (10) via an inverted reflective path (17) which has a converging focal point (18). One or more auxiliary feed horns (24,26) are operatively coupled directly to the main reflector so as to directly communicate therewith and reflect second energy within one or more additional radiation patterns (30,32). The first and second feed horns (24,26) are preferably located separate from the reflective path (17) so as to avoid interference therewith. In an alternate embodiment, a subreflector (12') with a hyperboloidal reflective surface (13') may be used.

12 Claims, 2 Drawing Sheets

SHAPED DUAL REFLECTOR ANTENNA SYSTEM FOR GENERATING A PLURALITY OF BEAM COVERAGES

BACKGROUND OF THE INVENTION

1. Technical Field

This invention relates generally to antenna reflector systems and, more particularly, to a system and method for generating a plurality of beam coverages with a dual-reflector antenna system.

2. Discussion

Communication satellites and the like commonly employ antenna reflector systems for focusing or reflecting signals within beam radiation patterns. Shaped reflectors have been provided, which in combination with a single feed, have been employed to cover a selected shaped beam radiation pattern. For instance, a shaped reflector may be deployed in space to provide adequate coverage throughout a geographic area such as the mainland portion of the United States. However, typical requirements imposed for communication satellites and the like have generally required coverage of the mainland portion of the United States as well as coverage of remote locations such as Hawaii, Puerto Rico and Alaska, for example.

Separate antenna reflector systems have been employed to separately generate each beam pattern coverage. Such systems generally require separate dual-reflector systems for each of the feed horns utilized therewith. This generally results in unnecessary complexity and weight which are undesirable for space-related applications and the like. It is conceivable that a dual-gridded shaped reflector could be used to provide multiple beam coverage to a limited extent. However, dual-gridded shaped reflectors must conform with dual linear polarization specifications. In addition, the dual gridded reflector requires polarization grids which generally results in rather extensive manufacturing requirements and high costs amongst other disadvantages.

More recently, a conventional dual-reflector antenna system exists for providing a main beam coverage in addition to a secondary spot beam coverage. The conventional dual-reflector antenna system generally includes a subreflector that is positioned to communicate with a main reflector. While transmitting, the subreflector is illuminated with a primary energy signal generated by a first feed horn. The primary energy signal is reflected off the subreflector and the main reflector to produce a first or main beam coverage. In addition, the conventional dual-reflector configuration usually employs a second feed horn which is generally positioned beside the main feed horn. The second feed horn likewise illuminates the subreflector with a second energy signal which in turn is reflected from the main reflector to produce a second or secondary spot beam coverage.

While the conventional dual-reflector configuration may serve well for some applications, there are limitations which generally make it unfeasible for space related applications and the like. For instance, the secondary spot beam may be required to cover a much smaller geographic area than the main beam coverage. Due to the difference in the sizes of the main beam and the spot beam coverage, the second feed horn must generally be defocused to get a good performance over the geographic area covered by the spot beam. This generally requires that one of the feed horns be positioned behind the other feed horn, thereby causing a partial blockage of one of the beam paths. In doing so, one of the feed horns is usually positioned within the beam coverage of the other feed horn. As a consequence, the partial blockage exhibited by the conventional dual-reflector configuration degrades the overall performance of the reflector antenna system.

It is therefore desirable to provide for an enhanced dual-reflector antenna system which more effectively generates a secondary spot beam coverage in addition to a main beam coverage. It is further desirable to provide for such a reflector antenna system which generates a plurality of secondary spot beam coverages. In particular, it is desirable to provide for such a multi-beam shaped dual-reflector configuration which does not suffer from feed horn blockage or interference such as that which exists with the aforementioned conventional approach. In addition, it is desirable to provide for a more highly integrated low cost dual-reflector antenna configuration which may be easily manufactured.

SUMMARY OF THE INVENTION

In accordance with the teachings of the present invention, a dual-reflector antenna system is provided for generating a shaped main beam radiation pattern and at least one secondary spot beam radiation pattern. The antenna system includes a main shaped reflector operatively coupled to a subreflector for communicating therewith. A main feed horn communicates directly with the subreflector so as to reflect energy to and from the main reflector within a main shaped beam radiation pattern. One or more auxiliary feed horns are provided which directly communicate with the main reflector so as to reflect energy within one or more secondary radiation beam patterns.

BRIEF DESCRIPTION OF THE DRAWINGS

Other objects and advantages of the present invention will become apparent to those skilled in the art upon reading the following detailed description and upon reference to the drawings in which.

DETAILED DESCRIPTION OF THE PREFERRED EMBODIMENTS

Figure 1:
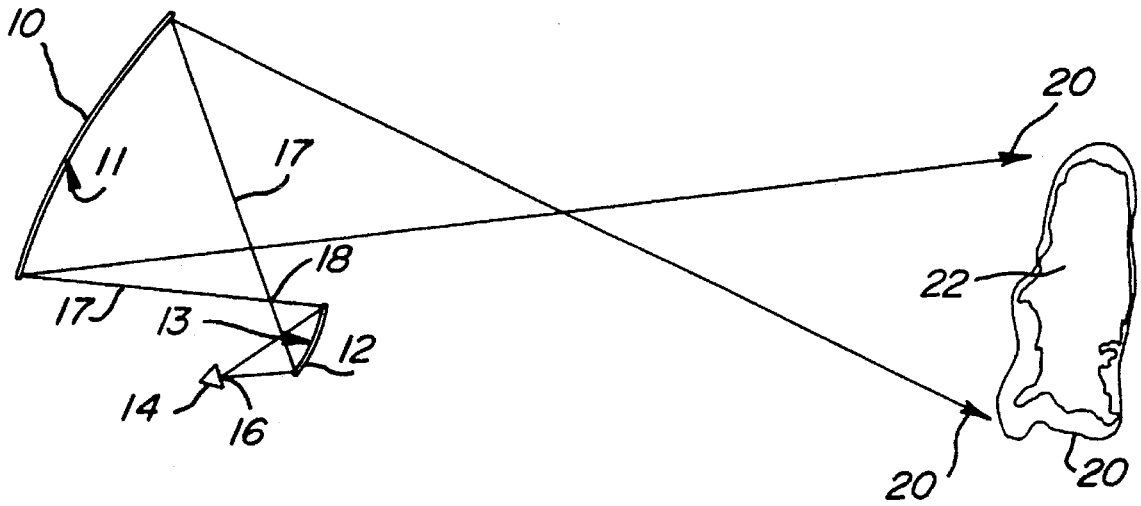
Fig-1 (PRIOR ART)
FIG. 1 is a side view of a conventional dual-reflector antenna system for reflecting radiating energy in a shaped beam radiation pattern.

Turning now to FIG. 1, a side view of a conventional offset fed shaped gregorian dual-reflector antenna system is illustrated therein. The antenna system is shown in accordance with one example for providing a shaped beam radiation coverage 20 over a geographic area such as the United States mainland 22. In doing so, the antenna system may be located on a satellite or other spacecraft which provides a field of view of the desired geographic area.

The dual-reflector antenna system includes a shaped main reflector 10 operatively coupled to an offset fed subreflector 12. The main reflector 10 has a shaped reflective surface 11 which generates phase error throughout the reflective surface of the main reflector 10 so as to provide a selected shaped beam radiation pattern 20. In the conventional Gregorian system, the subreflector 12 has an ellipsoidal reflective surface 13 which communicates directly with the shaped reflective surface 11 via an inverted beam pattern 17 which has a converging focal point 18 therebetween. A main feed horn 14 is operatively coupled to the ellipsoidal reflective surface 13 of subreflector 12 for communicating directly therewith.

The dual-reflector antenna system operates to transmit and/or receive energy within the shaped beam radiation pattern coverage 20. While transmitting, the main feed horn 14 directly illuminates the subreflector 12 which in turn reflects the energy and illuminates the shaped reflective surface 11 of main reflector 10. The main reflector 10 in turn reflects the energy within the shaped beam radiating pattern coverage 20. While receiving, the main shaped reflector 10 is illuminated with radiating energy received from the shaped beam radiation pattern coverage 20. The shaped reflector 10 in turn reflects and focuses the received energy so as to illuminate the ellipsoidal reflective surface 13 of subreflector 12. The focused energy is then received by the main feed horn 14 in the vicinity of a beam focal point 16.

Figure 2:
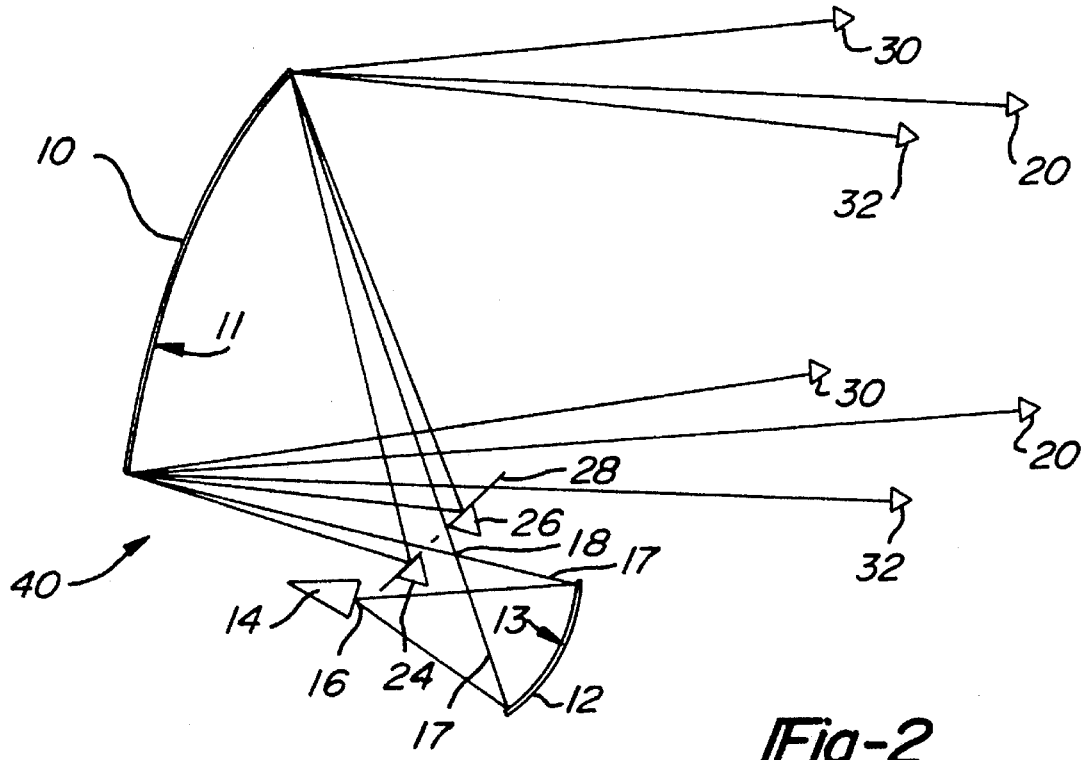
FIG. 2 is a side view of a gregorian dual-reflector antenna system which employs auxiliary feed horns in accordance with a preferred embodiment of the present invention.
Figure 3:
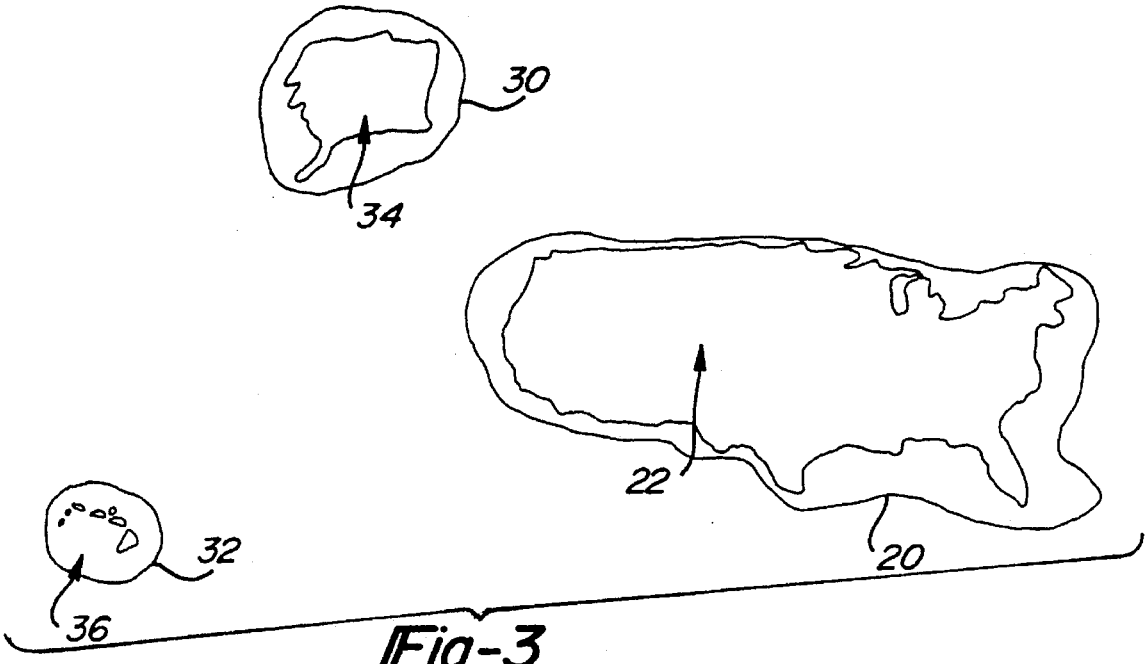
FIG. 3 is a pictorial representation of multiple beam radiation coverages provided by the dual-reflector antenna system in accordance with one example of the present invention.

With particular reference to FIGS. 2 and 3, a shaped dual-reflector antenna system 40 is shown for providing a plurality of beam radiation patterns 20, 30 and 32 in accordance with a preferred embodiment of the present invention. In doing so, the preferred embodiment employs a dual-reflector antenna system such as the one shown and described above in accordance with FIG. 1 for providing a main shaped beam radiation pattern coverage 20. According to the present invention, the shaped dual-reflector antenna system 40 further includes the addition of one or more auxiliary feed horns such as auxiliary feed horns 24 and 26. The auxiliary feed horns 24 and 26 are appropriately located so as to directly illuminate the shaped reflective surface 11 of shaped main reflector 10. That is, the auxiliary feed horns 24 and 26 are operatively coupled directly to the shaped reflective surface 11 without the use of subreflector 12. As shown in FIG. 2, auxiliary feed horns 24 and 26 are located in the vicinity of an effective focal plane 28 and are preferably located separate from the inverted beam pattern 17. As a result, the auxiliary feed horns 24 and 26 do not interfere with the radiating energy which passes between the main reflector 10 and subreflector 12 via inverted beam pattern 17. While the preferred embodiment is described herein in connection with two auxiliary feed horns 24 and 26, any number of auxiliary feed horns may be employed in accordance with the present invention.

In operation, auxiliary feed horn 24 illuminates the reflective surface 11 of the main shaped reflector 10 so as to transmit and/or receive radiating energy within a first secondary spot beam radiation pattern coverage 30. Beam radiation pattern coverage 30 may, for instance, be employed to cover a geographic area such as Alaska 34. The second auxiliary feed horn 26 likewise directly illuminates the shaped reflective surface 11 of main reflector 10 so as to transmit and/or receive radiating energy within a second secondary spot beam radiation pattern coverage 32. Beam radiation pattern coverage 32 may, for instance, cover a geographic area such as Hawaii 36.

While the main shaped beam radiation pattern coverage 20 and first and second secondary spot beam radiation pattern coverages 30 and 32 are shown separate from one another in a particular embodiment in FIG. 3, the beam pattern coverages 20, 30, and 32 may be provided for in a number of sizes and locations to achieve the desired beam pattern coverages. For instance, feed horns 14, 24 and 26 may be axially moved along each respective associated beam axis so as to focus or defocus the size of the respective beam pattern coverage associated therewith. In addition, the auxiliary feed horns 24 and 26 may be moved along the effective focal plane 28 so as to change the location of the spot beam radiation pattern coverages 30 and 32. That is, feed horns 24 and 26 may be positioned further away from inverted beam pattern 17 along effective focal plane 28 for purposes of providing beam pattern coverages 30 and 32 which are further displaced from beam pattern 20.

Figure 4:
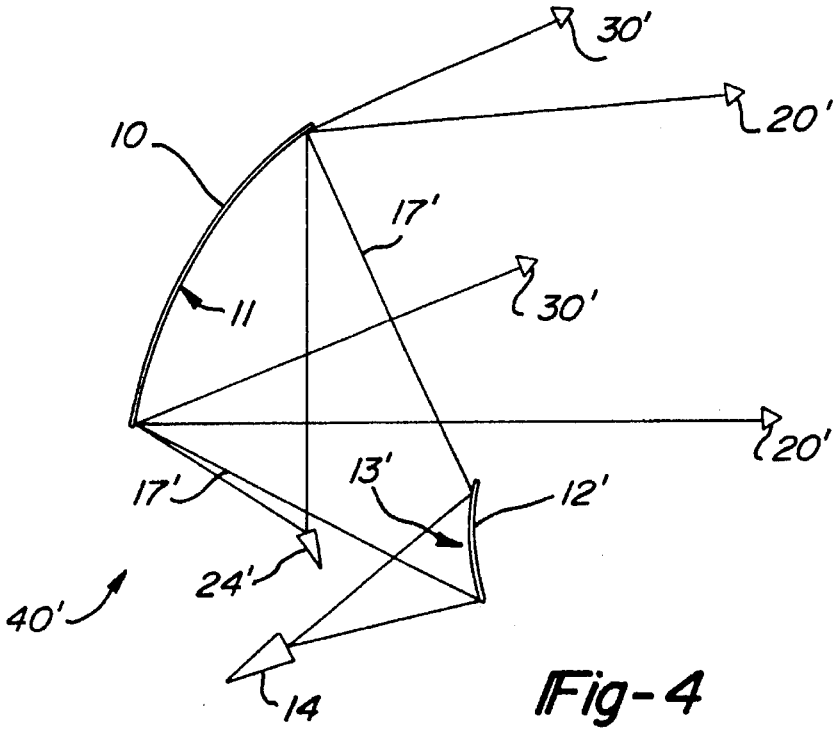
FIG. 4 is a side view of a cassegrain dual-reflector antenna system which employs auxiliary feed horns in accordance with an alternate embodiment of the present invention.

While the preferred embodiment has been described in connection with a gregorian dual-reflector, it is conceivable that other subreflector shapes such as a hyperboloidal subreflector with a hyperbolic shape may be employed in place of the elliptical shape without departing from the spirit of this invention. In accordance with an alternate embodiment of the present invention, a cassegrain dual-reflector antenna system 40' which employs a hyperboloidal subreflector 12' with a hyperbolic reflective surface 13' is shown in FIG. 4.

The Cassegrain dual-reflector antenna system 40' may provide for a more compact system since the main reflector 10 and hyperboloidal subreflector 12' may be positioned closer to one another. However, a hyperbolic subreflector surface 13' generally has a more limited desirability in that a hyperbolic reflective surface 13' will not provide an effective converging focal point such as focal point 18. As a result, the auxiliary feed horns 24 and 26 generally will have to be located outside the beam pattern 17 in order to prevent any interference therewith. Thus, while the cassegrain system may provide a similar performance, such an arrangement may result in more limited operating capabilities.

In view of the foregoing, it can be appreciated that the present invention enables the user to achieve an enhanced dual-reflector antenna system 40 for generating one or more secondary beam coverages in addition to a main shaped beam radiation pattern. Thus, while this invention has been disclosed herein in combination with a particular example thereof, no limitation is intended thereby except as defined in the following claims. This is because a skilled practitioner will recognize that other modifications can be made without departing from the spirit of this invention after studying the specification and drawings.

What is claimed is:

1. An offset fed dual-reflector antenna system for providing a main beam coverage and at least one spot beam coverage, said system comprising:

a main reflector having a first shaped reflective surface for reflecting energy within a shaped main beam radiation pattern having a given coverage;

a subreflector having an ellipsoidal surface for communicating with said first reflective surface of said main reflector via an inverted beam path having a converging focal point;

a first feed horn for directly communicating with the ellipsoidal reflective surface of said subreflector so as to transmit and/or receive energy reflected from said main reflector within a main beam pattern; and an auxiliary feed horn operatively coupled directly to said first shaped reflective surface of said main reflector for transmitting and/or receiving energy within a secondary beam radiation pattern without passing through the subreflector, said secondary beam radiation pattern having a coverage different from the primary beam pattern, and said auxiliary feed horn being spaced from said inverted beam path.

2. The antenna system as defined in claim 1 further comprising a plurality of auxiliary feed horns operatively coupled directly to said first shaped reflective surface of said main reflector for transmitting and/or receiving energy within a plurality of respective secondary beam patterns each having a different coverage, each auxiliary feed horn being located adjacent to yet spaced from the focal point of said inverted beam path.

3. The antenna system as defined in claim 2 wherein said auxiliary feed horns are located along a focal plane located between the main reflector and subreflector.

4. The antenna system as defined in claim 3 wherein said plurality of auxiliary feed horns are located in the vicinity of said converging focal point.

5. The antenna system as defined in claim 1 wherein said auxiliary feed horn communicates directly with said first reflective surface without illuminating the subreflector.

6. A method for generating a main radiation beam pattern and at least one secondary spot beam pattern with a dual-reflector antenna system, said method comprising:

illuminating an offset subreflector with first radiating energy provided by a first offset feed horn;

reflecting said first energy from said subreflector to a main reflector within a reflective path having a given coverage;

reflecting said first energy from said main reflector within a first beam pattern;

illuminating said main reflector with second energy provided by a second offset feed horn which is operatively coupled directly thereto without illuminating the subreflector and without the second energy passing through the subreflector, said second feed horn located spaced from said reflective path and adjacent a focal point of the subreflector; and reflecting said second energy from said main reflector within a second beam pattern having a coverage different from the coverage of the first beam pattern.

7. The method as defined in claim 6 wherein said first energy is reflected from said subreflector from an ellipsoidal reflective surface to said main reflector via an inverted beam pattern having a converging focal point.

8. The method as defined in claim 6 wherein said main reflector has a shaped reflective surface and produces a shaped beam pattern.

9. The method as defined in claim 6 wherein said subreflector has a hyperboloidal reflective surface.

10. The method as defined in claim 6 further comprising the steps of:

illuminating said main reflector with additional energy provided by a plurality of secondary feed horns which are operatively coupled directly to said main reflector; and reflecting said additional energy within a plurality of respective secondary beam patterns each having a different coverage.

11. The method as defined in claim 6 further comprising the steps of:

receiving incoming energy from said second beam pattern; and focusing said incoming energy to said second feed horn.

12. The method of claim 6 which further comprises:

adjusting the position of the second feed horn axially relative to the main reflector to achieve a desired size of the second beam pattern coverage.

* * * * *